US012781619B2

(12) United States Patent
Shokanov et al.

(10) Patent No.: US 12,781,619 B2
(45) Date of Patent: Nov. 3, 2026

(54) SYSTEMS AND METHODS FOR THE TRANSFER OF TRACER ADDITIVES INTO A WELLBORE

(71) Applicant: QuantumPro, Inc., Houston, TX (US)

(72) Inventors: Talgat Shokanov, Houston, TX (US); Quanxin Guo, Sugar Land, TX (US); John Oliver, Sugar Land, TX (US); Adil Mukhitov, Houston, TX (US)

(73) Assignee: QuantumPro, Inc., Houston, TX (US)

( * ) Notice: Subject to any disclaimer, the term of this patent is extended or adjusted under 35 U.S.C. 154(b) by 0 days.

(21) Appl. No.: 18/771,882

(22) Filed: Jul. 12, 2024

(65) Prior Publication Data

US 2026/0015938 A1 Jan. 15, 2026

(51) Int. Cl.
*E21B 47/11* (2012.01)
*E21B 41/00* (2006.01)

(52) U.S. Cl.
CPC ..... *E21B 47/11* (2020.05); *E21B 41/0064* (2013.01)

(58) Field of Classification Search
CPC ..... E21B 47/10; E21B 47/11; E21B 47/111; E21B 41/0064
USPC ..... 166/250.12, 250.01, 252.6
See application file for complete search history.

(56) References Cited

U.S. PATENT DOCUMENTS 6,645,769 B2 * 11/2003 Tayebi ..... G01N 33/2882 436/27
11,808,102 B1 * 11/2023 Roberts ..... E21B 33/1208
2005/0205264 A1 * 9/2005 Starr ..... E21B 33/12 166/243
2011/0024111 A1 * 2/2011 Moen ..... E21B 47/11 166/278
2011/0257944 A1 * 10/2011 Du ..... E21B 43/267 703/2
2013/0044858 A1 * 2/2013 Allen ..... G01N 23/223 378/208
2016/0075937 A1 * 3/2016 Cannan ..... C09K 8/80 166/250.1
2016/0153246 A1 * 6/2016 Brown ..... E21B 47/11 166/380
2018/0087369 A1 * 3/2018 Sherman ..... E21B 29/00
2023/0279771 A1 * 9/2023 Murugesan ..... E21B 49/088 166/250.12

FOREIGN PATENT DOCUMENTS

CN 107740690 A * 2/2018 ..... E21B 49/088

OTHER PUBLICATIONS

Translation of CN 107740690 A (Year: 2018).*

* cited by examiner

*Primary Examiner* — Angela M DiTrani Leff
(74) *Attorney, Agent, or Firm* — Kearney, McWilliams & Davis, PLLC; John M. DeBoer

(57) ABSTRACT

A method of using a tracer additive in a wellbore that includes using a tubestring with a downhole tool coupled therewith, and associating with or otherwise disposing the tracer additive with the downhole tool. The method includes providing the tubestring into the wellbore in manner whereby the downhole tool arrives at a desired location, and sufficiently dissolving a dissolvable material so that the tracer additive comes into contact with a target formation fluid. The tracer additive has a first composition, and is in a solid powder form.

18 Claims, 7 Drawing Sheets

SYSTEMS AND METHODS FOR THE TRANSFER OF TRACER ADDITIVES INTO A WELLBORE

BACKGROUND

Field of the Disclosure

This disclosure generally relates to the use of an innovative type of chemical additive known as a 'tracer' in a wellbore or other comparable subterranean formation. The tracer may be associated with or disposed into a downhole tool, and thereafter transferred into the wellbore for downhole deployment. At least some of the tracer may be removed from the targeted structure with a resultant produced fluid, then tested in a manner that facilitates determination of flow performance, or a model of one or more production parameters associated with the wellbore. Some embodiments relate to using tracer technology during a construction or completion phase of the wellbore.

Background of the Disclosure

A hydrocarbon-based economy continues to be dominant force in the modern world. As such, locating and producing hydrocarbons, along with understanding the flow performance of subsurface formations, continues to demand attention from the oil and gas (O&G) industry. A well or wellbore is generally drilled in order to recover valuable hydrocarbons and other desirable materials trapped in geological formations in the Earth, which are later refined into commercial products, such as gasoline or natural gas.

Once the drilling is finished, a production string is typically placed all the way into the wellbore, followed by some form of completion operation, such as the use of hydraulic fracturing (i.e., "fracing"). Fracing entails the pumping of fracturing fluids with sand into a formation in an open-hole or via perforations in a cased wellbore or other openings in the casing to form a fracture(s) in the formation. Fracing routinely requires very high fluid pressure and pumping rate and can occur in a multi-stage fracing manner.

A completion phase for a wellbore is expensive, increasingly environmentally challenging and emissions intensive, and can represent up to 70% of the total cost for each well. With such extensive costs, there may be situations where it is desirous to have some amount of diagnostic information about the well. For example, producers may desire to know when production occurs from a target formation, such as the bottom/toe end portion of a wellbore. For the sake of flow assurance, it might be desirous to have diagnostic information that may be decoupled from fracturing. It follows that it might be desirous to have diagnostic information about (a part of) the wellbore, but not necessarily a fractured arca.

Production diagnostic tools may be used in order to predict well performance, improve well design, or aid in future well development. Typically, diagnostic or surveillance tools include fiber, PLT (production logging), fiber-optic, and liquid chemical tracers.

Conventional chemical liquid tracers have enjoyed success but are also known to have limitations. These tracers are dissolvable in oil and water phases, and typically have fluorescent properties, DNA and ionic, organic materials, or radioactive diagnostic isotopes. Such tracers are used to evaluate fracturing performance, ostensibly to control the effectiveness of multi-stage hydraulic fracturing stimulation. Owing to obvious environmental deficiencies, tracers incorporating radioactive isotopes have largely fallen out of favor.

Given their soluble characteristics, conventional chemical tracers must be tailored for individual fluid types, thereby requiring more, and often exotic, formulations for a single stage, increasing the chemical tracer costs appreciably. Such tracers are known to be surface deployed (i.e., mixed with fluid and pumped into the wellbore).

Each of the aforementioned techniques: fiber, PLT, and liquid chemical tracer tools also have temperature limitations (i.e., for use in <500° F.) that make their use problematic at best in unconventional or igneous geothermal reservoirs, where temperatures may be as high as 1,000° F.

The industry needs a simplistic, low-cost diagnostic method that can be used for assessing reservoir quality, completion (or construction), and other wellbore performance parameters, especially for target areas of the formation (such as the wellbore bottom or toc) that need not be related to a particular 'stage'.

The need for an ultrahigh resolution nanoparticle tracer that is versatile, affordable, highly accurate, non-radioactive, non-intrusive and quick to test is increasing as never before for all applications. Thus, there is an urgent need to have accurate, affordable, timely data on wellbore performance or other information. What is needed is a new and improved way of forming and using a fast, cost-favorable, effective, and reliable way of evaluating a wellbore that can be decoupled from a fracturing operation.

SUMMARY

Embodiments of the disclosure pertain to a method of using a tracer additive in a wellbore that may include one or more steps described herein. The method may include using a deployment device, the deployment device configured with a hollowed region. There may be a tracer additive into the hollowed region. The tracer additive may be a solid particle tracer additive. The tracer additive may be inert and/or insoluble to any fluid associated (native, added, etc.) with the wellbore.

The method may pertain to a particular phase of wellbore operation, such as a construction phase or a completion phase. During such a phase, a tubestring may be disposed or otherwise made of use within the wellbore. There may be a downhole tool or component coupled with or positioned on the tubestring, such as at the downhole end of the tubestring. In aspects, the tubestring may be a drill string, a production string, or the like.

Once the tubestring is in position, the method may include waiting (or allotting, permitting, etc.) for an amount of time to pass whereby a dissolvable material associated with the downhole tool sufficiently dissolves so that the solid particle tracer additive may thus come into contact with a target formation fluid. Without such time passing, the solid particle tracer additive may be prevented from contacting the target formation fluid.

The construction phase may be contemplated as a first period of time that occurs starting at a point in time when drilling the wellbore starts (i.e., using a drill string, bit, etc.) and ending at a latter point in time when a first amount of fluid is produced from the section of the wellbore. The completion phase may be contemplated as a first period of time that occurs starting at a point in time when a drill string is removed from the wellbore and ending at a latter point in time when a first amount of fluid is produced from the section of the wellbore.

The downhole tool may have a deployment device associated or coupled therewith. In aspects, the solid particle tracer additive may be in a hollowed region of the deployment device, and thus initially isolated from contacting the target formation. The method may include sufficiently dissolving (or letting dissolve) the deployment device so that the tracer additive may be able to come into contact with the target formation and/or respective formation fluid.

Upon contact with the target formation fluid for an amount of time, the method may include returning a remnant fluid that includes at least a portion of the tracer additive to a surface.

In aspects, the solid particle tracer additive may have a first tracer composition. The tracer additive may be in a solid powder form having an average particle diameter of at least 0.01 μm to no more than 10 μm. The tracer additive may have an average bulk specific gravity, such as in a range of at least 0.6 to no more than 1.6.

There may be instances where the wellbore (or surrounding formation) has certain geological parameters, for example, the wellbore may be associated with a formation temperature of at least 200° F. to no more than 1,000° F.

The method may include other steps, such as any of: taking a sample of the remnant fluid; testing the sample in order to analyze the remnant fluid in order to provide a set of fluid data; and/or integrating the set of fluid data with other wellbore data in order to determine a parameter associated with performance of the wellbore.

In some aspects, the deployment device may have a desired shape, such as being a cylindrical or elongated (rod-shaped) member. The deployment device may be configured to be separated into at least two sections. Other shapes or sizes may be possible.

These and other embodiments, features and advantages will be apparent in the following detailed description and drawings.

BRIEF DESCRIPTION OF THE DRAWINGS

A full understanding of embodiments disclosed herein is obtained from the detailed description of the disclosure presented herein below, and the accompanying drawings, which are given by way of illustration only and are not intended to be limitative of the present embodiments, and wherein.

DETAILED DESCRIPTION

Figure 1A:
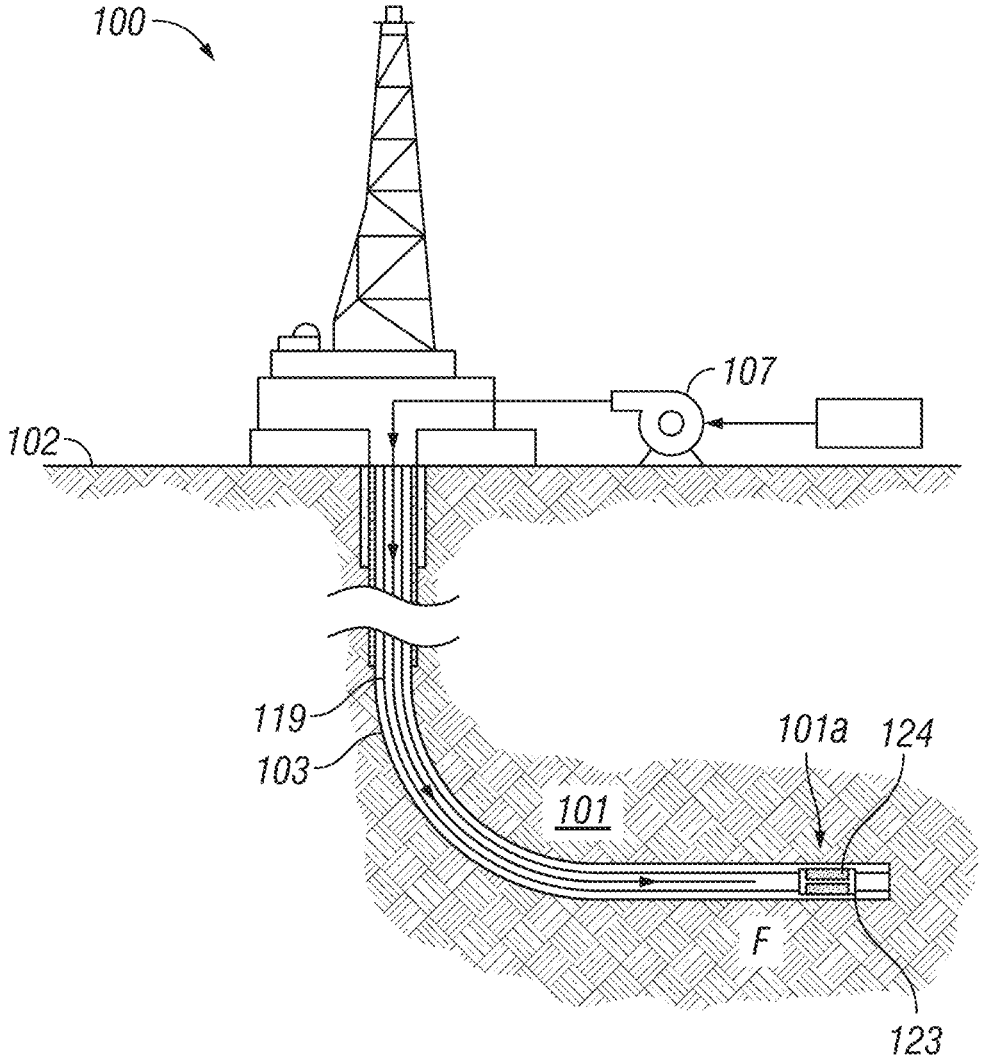
FIG. 1A shows a side view of a system for using a downhole tool for the transfer of a tracer additive into a wellbore according to embodiments of the disclosure.

Regardless of whether presently claimed herein or in another application related to or from this application, herein disclosed are novel apparatuses, units, systems, and methods that pertain to use of solid tracer additives, details of which are described herein. Embodiments of the disclosure may refer to "in-wellbore or downhole deployment" of the tracer—where the tracer is in the wellbore (in a deployment device or run-in with a downhole tool) before deployment of the tracer into the wellbore occurs.

Embodiments of the present disclosure are described in detail with reference to the accompanying Figures. In the following discussion and in the claims, the terms "including" and "comprising" are used in an open-ended fashion, such as to mean, for example, "including, but not limited to . . . ". While the disclosure may be described with reference to relevant apparatuses, systems, and methods, it should be understood that the disclosure is not limited to the specific embodiments shown or described. Rather, one skilled in the art will appreciate that a variety of configurations may be implemented in accordance with embodiments herein.

Although not necessary, like elements in the various figures may be denoted by like reference numerals for consistency and ease of understanding. Numerous specific details are set forth in order to provide a more thorough understanding of the disclosure; however, it will be apparent to one of ordinary skill in the art that the embodiments disclosed herein may be practiced without these specific details. In other instances, well-known features have not been described in detail to avoid unnecessarily complicating the description. Directional terms, such as "above," "below," "upper," "lower," "front," "back," etc., are used for convenience and to refer to general direction and/or orientation, and are only intended for illustrative purposes only, and not to limit the disclosure.

Connection(s), couplings, or other forms of contact between parts, components, and so forth may include conventional items, such as lubricant, additional sealing materials, such as a gasket between flanges, PTFE between threads, and the like. The make and manufacture of any particular component, subcomponent, etc., may be as would be apparent to one of skill in the art, such as molding, forming, press extrusion, machining, or additive manufacturing. Embodiments of the disclosure provide for one or more components to be new, used, and/or retrofitted to existing machines and systems.

Various equipment may be in fluid communication directly or indirectly with other equipment. Fluid communication may occur via one or more transfer lines and respective connectors, couplings, valving, piping, and so forth. Fluid movers, such as pumps, may be utilized as would be apparent to one of skill in the art.

Numerical ranges in this disclosure may be approximate, and thus may include values outside of the range unless otherwise indicated. Numerical ranges include all values from and including the expressed lower and the upper values, in increments of smaller units. As an example, if a compositional, physical or other property, such as, for example, molecular weight, viscosity, melt index, etc., is from 100 to 1,000. it is intended that all individual values, such as 100, 101, 102, etc., and sub ranges, such as 100 to 144, 155 to 170, 197 to 200, etc., are expressly enumerated. It is intended that decimals or fractions thereof be included.

For ranges containing values which are less than one or containing fractional numbers greater than one (e.g., 1.1, 1.5, etc.), smaller units may be considered to be 0.0001, 0.001, 0.01, 0.1, etc. as appropriate. These are only examples of what is specifically intended, and all possible combinations of numerical values between the lowest value and the highest value enumerated, are to be considered to be expressly stated in this disclosure. Numerical ranges are provided within this disclosure for, among other things, the relative amount of reactants, surfactants, catalysts, etc. by itself or in a mixture or mass, and various temperature and other process parameters.

Terms

The term "connected" as used herein may refer to a connection between a respective component (or subcomponent) and another component (or another subcomponent), which can be fixed, movable, direct, indirect, and analogous to engaged, coupled, disposed, etc., and can be by screw, nut/bolt, weld, and so forth. Any use of any form of the terms "connect", "engage", "couple", "attach", "mount", etc. or any other term describing an interaction between elements is not meant to limit the interaction to direct interaction between the elements and may also include indirect interaction between the elements described.

The term "fluid" as used herein may refer to a liquid, gas, slurry, single phase, multi-phase, pure, impure, etc. and is not limited to any particular type of fluid such as hydrocarbons.

The term "utility fluid" as used herein may refer to a fluid used in connection with any fluid disposed into a wellbore (akin to an injection fluid). The utility fluid may be pressurized, and may be used to carry an additive into the wellbore. 'Utility fluid' may also be referred to and interchangeable with 'service fluid' or comparable.

The term "fluid connection", "fluid communication," "fluidly communicable," and the like, as used herein may refer to two or more components, systems, etc. being coupled whereby fluid from one may flow or otherwise be transferrable to the other. The coupling may be direct, indirect, selective, alternative, and so forth. For example, valves, flow meters, pumps, mixing tanks, holding tanks, tubulars, separation systems, and the like may be disposed between two or more components that are in fluid communication.

The term "pipe", "conduit", "line", "tubular", or the like as used herein may refer to any fluid transmission means, and may be tubular in nature.

The term "tubestring" or the like (also 'workstring') as used herein may refer to a tubular (or other shape) that may be run into a wellbore. The tubestring may be a drillstring, workstring, casing, a liner, production tubing, combinations, and so forth. The tubestring may be multiple pipes (and the like) coupled together. The tubestring may be used for transfer of fluids, or used with some other kind of action, such as drilling, running a tool, or any other kind of downhole action, and combinations thereof.

The term "composition" or "composition of matter" as used herein may refer to one or more ingredients, components, constituents, etc. that make up a material (or material of construction). Composition may refer to a flow stream of one or more chemical components.

The term "chemical" as used herein may analogously mean or be interchangeable to material, chemical material, ingredient, component, chemical component, element, substance, compound, chemical compound, molecule(s), constituent, and so forth and vice versa. Any 'chemical' discussed in the present disclosure need not refer to a 100% pure chemical. For example, although 'water' may be thought of as H2O, one of skill would appreciate various ions, salts, minerals, impurities, and other substances (including at the ppb level) may be present in 'water'. A chemical may include all isomeric forms and vice versa (for example, "hexane", includes all isomers of hexane individually or collectively).

The term "reactive material" as used herein may refer a material with a composition of matter having properties and/or characteristics that result in the material responding to a change over time and/or under certain conditions. The term reactive material may encompass degradable, dissolvable, disassociatable, dissociable, and so on.

The term "dissolvable material" may be analogous to degradable material. The term as used herein may refer to a composition of matter having properties and/or characteristics that, while subject to change over time and/or under certain conditions, lead to a change in the integrity of the material, including to the point of degrading, or partial or complete dissolution. As one example, the material may initially be hard, rigid, and strong at ambient or surface conditions, but over time (such as within about 12-60 hours) and under certain conditions (such as wellbore conditions), the material softens. As another example, the material may initially be hard, rigid, and strong at ambient or surface conditions, but over time (such as within about 12-240 hours) and under certain conditions (such as wellbore conditions), the material dissolves at least partially, and may dissolve completely. The material may dissolve via one or more mechanisms, such as oxidation, reduction, deterioration, go into solution, or otherwise lose sufficient mass and structural integrity.

The term "water" as used herein may refer to a pure, substantially pure, and impure water-based stream, and may include wastewater, process water, fresh water, seawater, produced water, slop water, treated variations thereof, mixes thereof, etc., and may further include impurities, dissolved solids, ions, salts, minerals, and so forth. Water for a frac fluid can also be referred to as 'frac water'.

The term "impurity" as used herein may refer to an undesired component, contaminant, etc. of a composition. For example, a mineral or an organic compound may be an impurity of a water stream.

The term "frac fluid" as used herein may refer to a fluid injected into a well as part of a frac operation. Frac fluid is often characterized as being largely water, but with other constituents such as proppant, friction reducers, and other additives or compounds.

The term "produced fluid", "production fluid", and the like as used herein may refer to water, gas, mixtures, and the like recovered from a subterranean formation or other area near the wellbore. Produced fluid may include hydrocarbons or aqueous, such as flowback water, brine, salt water, or formation water. Produced water may include water having dissolved and/or free organic materials. Produced fluid may be akin to 'wellbore fluid', in that the fluid may be returned from the wellbore. Produced fluid may include utility fluids and formation fluids.

The term "frac operation" as used herein may refer to fractionation of a downhole well that has already been drilled. 'Frac operation' can also be referred to and interchangeable with the terms fractionation, hydraulic fracturing, well stimulation, production enhancement, hydrofracturing, hydrofracking, fracking, fracing, and frac. A frac operation can be land or water based. Generally, the term 'fracing' or 'frac' is used herein, but meant to be inclusive to other related terms of industry art.

The phrase "processing a fluid" as used herein may refer to some kind of active step or action, such as man-made or by machine, imparted on the fluid (or fluids). For example, a fluid may be received into a device (such as a mixer) and upon processing, may leave as a 'processed fluid'. 'Processed' is not meant be limited, as this may include reference to transferred, treated, tested, measured, mixed, sensed, separated, combinations, etc. in whatever manner may be desired or applicable for embodiments herein. It is noted that while various steps or operations of any embodiment herein may be described in a sequential manner, such steps or operations may be operated in batch or continuous fashion.

The term "tracer" as used herein may refer to an identifiable substance, such as a liquid dye, liquid chemical or powder particles, which may be followed through the course of a mechanical, chemical, or biological process. In the present disclosure, a tracer may be used in a well, and the resultant process impact on the tracer evaluated. In this respect, the tracer may help evaluate, determine, and otherwise model well production and performance. The tracer may be added (and thus may be referred to as a 'tracer additive' or 'additive') to a utility (or service, injection, etc.) fluid disposed into the well.

The term "nanoparticle" as used herein may refer to a small particle that ranges between 1 to 1000 nanometers in size diameter, and is undetectable by the human eye. A tracer in powder form may be nanoparticles. A tracer additive of the present disclosure may be in (solid) powder form with an average bulk particle diameter in a range of about 0.01 μm to about 10 μm.

The term "EDXRF" (Non-destructive Energy Dispersive X-Ray Fluorescence) as used herein may refer to a type of spectroscopy process (and may thus include use of a spectrometer) where a sample of material (such as a portion of produced fluid) is 'excited' in order to collect emitted fluorescence radiation, which may then be evaluated for different energies of the characteristic radiation from each of the different constituents (or elements) in the sample. The EDXRF process may be referred to as a fluorescence response-based analytical process.

EDXRF may be considered a non-destructive analytical technique used to determine the elemental composition of materials. EDXRF analyzers determine the elemental composition of a sample by measuring the fluorescent (or secondary detectable energy) X-ray emitted from a sample when it is excited by a primary X-ray source. EDXRF is designed to analyze groups of elements simultaneously to determine those elements presence in the sample and their relative concentrations—in other words, the elemental composition of the sample. Each of the elements present in a sample produces a unique set of characteristic X-rays that is a "fingerprint" for that specific element. X-rays have a very short wavelength, which corresponds to very high energy. All atoms have several electron orbitals (K shell, L shell, M shell, for example). When X-ray energy causes electrons to transfer in and out of these shell levels, X-ray fluorescence peaks with varying intensities are created and will be present in the spectrum. The peak energy identifies the element, and the peak height or intensity is indicative of its concentration.

The term "XRD" may refer to X-ray diffraction, which is a technique for analyzing the atomic or molecular structure of materials. It is non-destructive, and works most effectively with materials that are wholly, or part, crystalline. The technique is often known as x-ray powder diffraction because the material being analyzed typically is a finely ground down to a uniform state. Diffraction is when light bends slightly as it passes around the edge of an object or encounters an obstacle or aperture. The degree to which it occurs depends on the relative size of a wavelength compared to the dimensions of the obstacle or aperture it encounters.

All diffraction methods start with the emission of x-rays from a cathode tube or rotating target, which is then focused at a sample. By collecting the diffracted x-rays, the sample's structure can be analyzed. This is possible because each mineral has a unique set of d-spacings. D-spacings are the distances between planes of atoms, which cause diffraction peaks.

The term "completion phase" as used herein may refer to a period of time in the operation of a wellbore from when drilling has finished (and the drillstring removed) to when a first fluid production from the wellbore begins.

The term "construction phase" as used herein may refer to a period of time in the operation of a wellbore from when drilling first starts to when a first fluid production from the wellbore begins. The construction phase may include the completion phase.

Referring now to FIGS. 1A, 1B, 1C, 2, and 3, together, a side view of a system for using a downhole tool for the transfer of a tracer additive into a wellbore, a side view of the system with an at least partially dissolved deployment device that releases the tracer additive into the wellbore, a side view of a system for using a second downhole tool for the transfer of another or second tracer additive into a wellbore, a side view of a system where a remnant fluid with a tracer additive is produced from a wellbore, and a simplified block diagram of an analytical unit used to test a fluid sample having a tracer additive, respectively, according to embodiments disclosed herein, are shown.

System 100 may include one or more components (or subcomponents) coupled with new, existing, or retrofitted equipment. System 100 may include one or more units that are skid mounted or may be a collection of skid units, and the system 100 may be suitable for onshore and offshore environments.

The system 100 may have various valves, flanges, pipes, pumps, utilities, monitors, sensors, controllers, flow meters, safety devices, etc., for accommodating sufficient universal coupling between system components and any applicable feedline/feed source of a material to be processed, any resultant product material to be discharged or transferred therefrom, and anything in between.

Figure 1B:
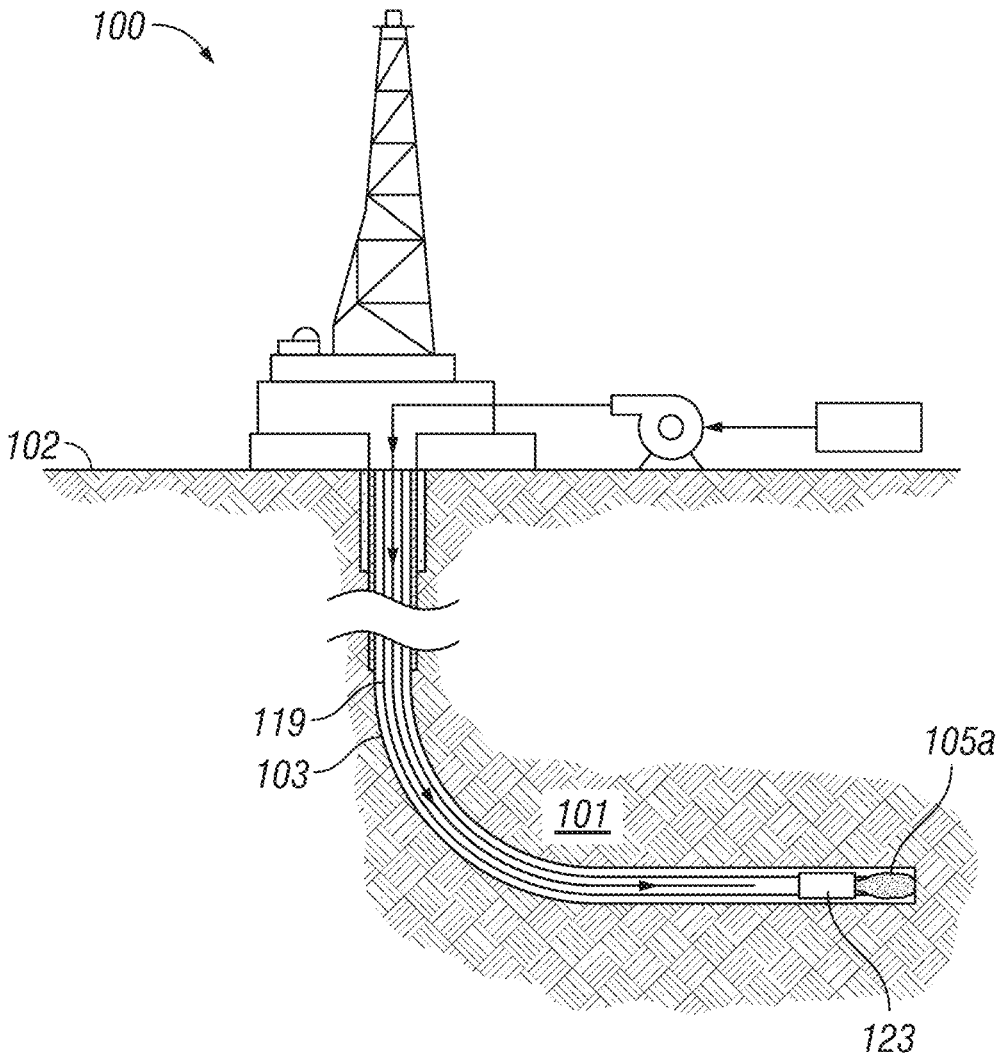
FIG. 1B shows a side view of the system of FIG. 1A with an at least partially dissolved deployment device that releases the tracer additive into the wellbore according to embodiments of the disclosure.
Figure 1C:
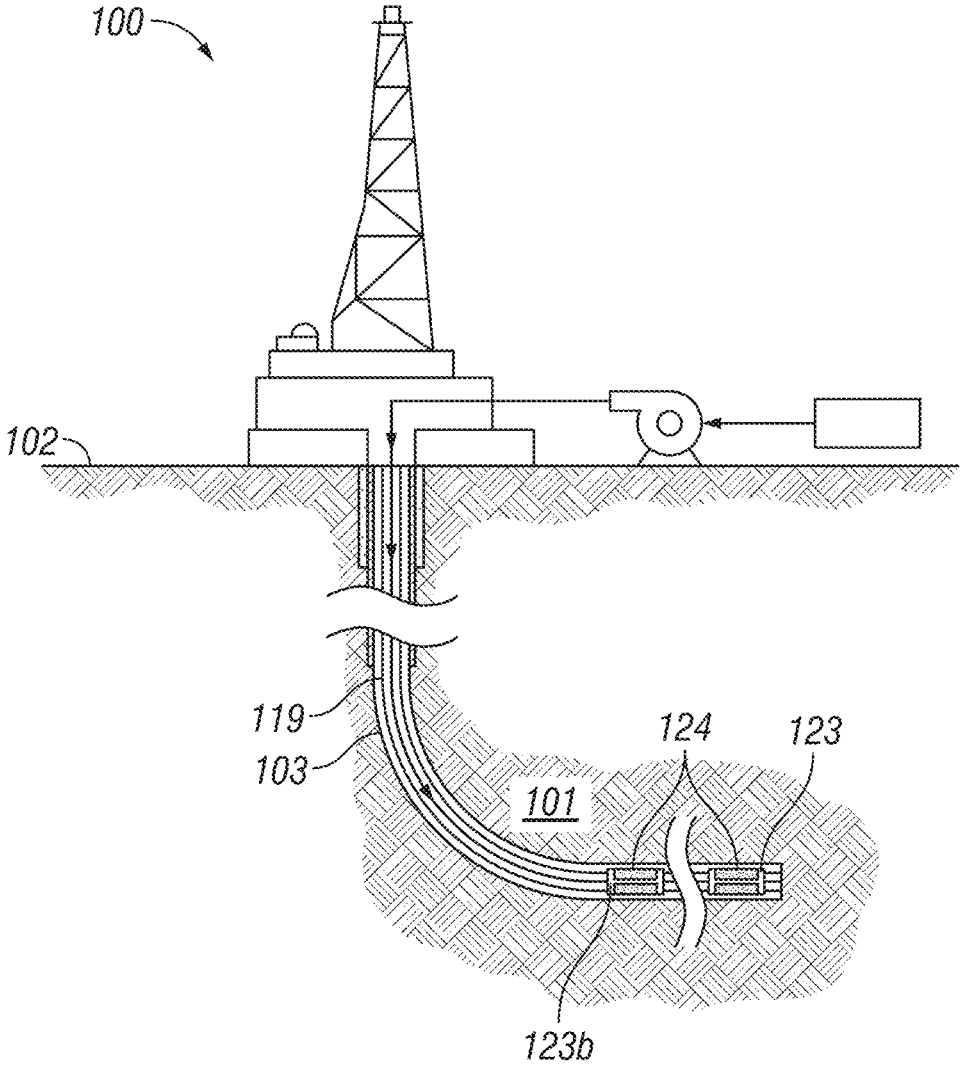
FIG. 1C shows a side view of a system for using a second downhole tool for the transfer of another or second tracer additive into a wellbore according to embodiments of the disclosure.

FIGS. 1A-1C are meant to show in a simplistic manner embodiments herein, and may not be to scale. The system 100 may include a subterranean or earthen formation 101 having a wellbore 103 drilled or otherwise formed therein. The formation 101 may contain hydrocarbonaceous fluids, such as oil, natural gas, and/or other materials, generally designated as F. The formation 101 may include porous and permeable rock containing liquid and/or gaseous hydrocarbons. The formation may include a conventional reservoir, an unconventional reservoir, a tight gas reservoir, and/or other types of reservoirs. Moreover, the illustration of a mover (pump) 107 is not meant to infer other equipment is not present, of which one of ordinary skill in the art is well versed. The type of mover 107 used is not meant to be limited, and other types of movers 107 may be used (even if not shown).

The system 100 may include one or more additional wellbores, production wells, etc. The example wellbore 103 shown illustrates the wellbore 103 may have at least a partial horizontal trajectory. However, any wellbore of the system 100 may include any combination of horizontal, vertical, slant, curved, directional-drilled, and/or other well geometries.

The wellbore 103 may be open, closed, cased, uncased, etc. Although not shown in detail here, the wellbore 103 may have a tubestring (workstring, drill string, production string, etc.) 119 disposed therein, such as for deploying tools or fluids into the wellbore 103. In other aspects, the tubestring 119 may be a production tubing, whereby formation and wellbore fluids may be readily transported to and/or from a surface or surface facility 102.

The formation 101 may include a target formation 101*a*, which may be believed to be a hydrocarbon-rich area of the formation 101. The target formation 101*a* may be a stage or zone, which may be part of or associated with a completion operation (such as fracing). It may be the case that the target formation 101*a* has perforations, which may result from a fracing operation or may naturally exist.

In the event of tight formation characteristics, such as in the case of an unconventional reservoir, the target formation 101*a* may have an average permeability of about 0.1 nanodarcy to about 1000 nanodarcy. By way of comparison, the target formation 101*a* may be disposed in a conventional reservoir, and thus may have an average permeability in a range of about 0.1 millidarcy to about 1 darcy (or more).

The formation 101 might have other geologic characteristics, including hot formation temperatures. For example, the target formation 101*a* may have an average formation temperature T of about 450° F. In embodiments, the average formation temperature T may be in a range of about 200° F. to about 1,000° F. The formation temperature T may have a relationship to the depth, geological environment, and tightness of the formation 101.

Diagnostic information about the performance of the wellbore 103, or particular area such as by the target formation 101*a*, may be determined by utilizing a first tracer additive 105*a*. The first tracer additive 105*a* (or other tracer additives described herein) may be of a suitable material for use with any type of formation 101. Just the same, the first tracer additive 105*a* may have a (predetermined) first composition, which results in characteristics (or traits) suitable for use in the event the formation 101 has conditions normally undesirable for the use of tracers, namely, liquid tracers. The first tracer additive may be solid particle, inert, and/or insoluble.

As a first characteristic, the first tracer 105*a* may be a solid tracer in the form of a powder. The use of powder form makes the first tracer 105*a* attractive for use in high temperature conditions. The first tracer 105*a* may comprise powder nanoparticles. In embodiments, the particles of the first tracer 105*a* may have a bulk average particle diameter of about 0.1 μm to about 10 μm. The first tracer 105*a* may have a first tracer specific gravity. In embodiments, the first tracer 105*a* may have an average bulk specific gravity of about 0.6 to about 1.6. The first tracer 105*a* may be associated with or disposed into/onto a downhole tool 123.

The downhole tool 123 may be coupled with or part of the tubestring 119. The downhole tool 123 may be any kind of tool suitable for use in the wellbore 103, such as a frac plug (or other desired completion tool), a drill bit (or part thereof), a (sand) screen, and so forth. The downhole tool 123 may be, or include a component part thereof, configured to hold, convey, and subsequently deploy, the first tracer 105*a*.

As shown here, the downhole tool 123 may have a first deployment device 124. Although not meant to be limited, the first deployment device 124 may be cylindrical or elongated in nature. The deployment device 124 may have an outer diameter. The outer diameter may be in the range of about 0.2 inches to about 5 inches. For example, the outer diameter may be 0.25 inches, 0.5 inches, 1 inch, and so forth.

Figure 4:
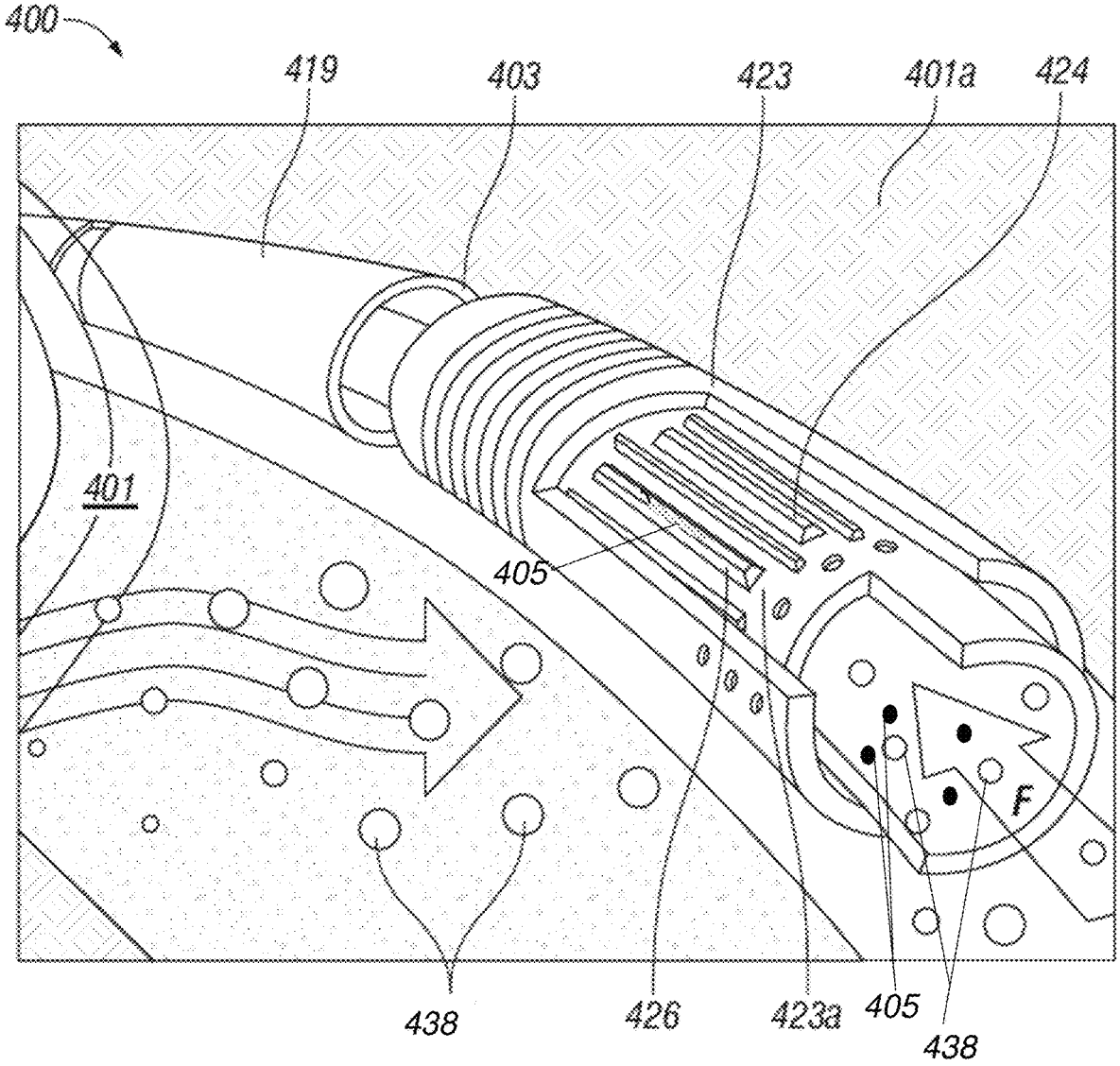
FIG. 4 shows a close-up downhole view of a system having a downhole tool having a dissolvable deployment device according to embodiments of the disclosure.

Referring briefly to FIG. 4, a close-up downhole view of a system having a downhole tool with a dissolvable deployment device, in accordance with embodiments disclosed herein, is shown.

FIG. 4 is meant to show in simplified form that a system 400 for use with embodiments herein may have a downhole tool 423 coupled with a tubestring 419. The tubestring 419 may be used to run or otherwise position the downhole tool in the formation 401 at a particular target area (zone, region, etc.) 401*a*.

The downhole tool 423 may be a completion tool or the like. The downhole tool 423 may have a tool body 423*a*, which may be configured with a receptacle or housing 426. The receptacle 426 may be suitable for placing or disposing a deployment device 424 therein. As shown, the downhole tool 423 may have one or more deployment devices 424.

The downhole tool 423 (or deployment device) may have a tracer additive 405 of the like described for embodiments herein associated with, or otherwise disposed therein. In aspects, the deployment device 424 may have the tracer additive 405 disposed within, such that the tracer additive 405 may be conveyed into the wellbore 403 for downhole deployment (release, etc.) (in contrast to surface deployment).

To prevent the tracer additive 405 from inadvertent deployment or contact with the target formation 401*a* (or associated wellbore fluid(s) F), the downhole tool 423 and/or the deployment device 424 may include a dissolvable material. In this respect, the tracer additive 405 may be prevented from deployment until the dissolvable material has dissolved in a sufficient manner. Once released, the tracer additive 405 may mingle, disperse, interact, etc. with the target formation 401 and/or fluid(s) F. The fluid F or a sample thereof (which may have at least some of the additive 405 and at least some hydrocarbon component 438 [each shown symbolically as a large spherical droplet(s), and not to scale]) may be returned to the surface, and subsequently tested.

In embodiments, one or more components may be made of a metallic material, such as an aluminum-based or magnesium-based material. The metallic material may be reactive, such as dissolvable, which is to say under certain conditions the respective component(s) may begin to dissolve. These conditions may be anticipated and thus predetermined. In embodiments, any components of the tool 423 may be made of dissolvable aluminum-, magnesium-, or aluminum-magnesium-based (or alloy, complex, etc.) material.

Returning again to FIGS. 1A, 1B, 1C, 2, and 3, together, the deployment device 124 may be sent or disposed into the wellbore 103 via the tubestring 119. After an amount of time (which may be predetermined or otherwise known), the deployment device 124 may dissolve sufficiently enough that the first tracer 105*a* may begin to disperse in or at the target formation 101*a*.

The deployment device 124 shown in FIG. 1A shows the first tracer 105*a* for illustrative purpose, although the first tracer 105*a* may not be visible unless or until the deployment device 124 (sufficiently) dissolves. On the other hand, there may be one or more embodiments where the first tracer 105*a* may be visible (or more exposed) or part of a surface component or coating (e.g., 636, FIG. 6C).

The amount of time for dispersion to begin may be about 24 hours to about 60 hours, but could also be longer. In embodiments, the amount of time may be about 2 days. In other embodiments, some applications may require days, weeks or even months before the tracer be released. How long it takes for the first tracer 105*a* to be released may be designed. The release time may also be based on the amount and/o composition of dissolvable material used, as well as whatever monitoring objective may be desired or used.

The first tracer 105*a* may be completely insoluble with the wellbore fluids F. The first tracer 105*a* may be inert in the respect that there is no effect by the first tracer 105*a* on the fluid F and/or the formation 101 (or target formation 101*a*) and/or vice versa.

The tracer 105*a* (or at least a portion thereof) may have an average residence time in the target formation 101*a*. The first tracer additive 105*a* may be selected for its particular uniqueness, and thus preferably has a different tracer characteristic (fingerprint) from other tracer additives used so that fluid returned to the surface may be identified. The tracer characteristic may be the chemical identity of the tracer additive used, such as composition or specific gravity. The tracer characteristic may be distinguishable from the tracer characteristic(s) of any other tracer additives used.

Figure 2:
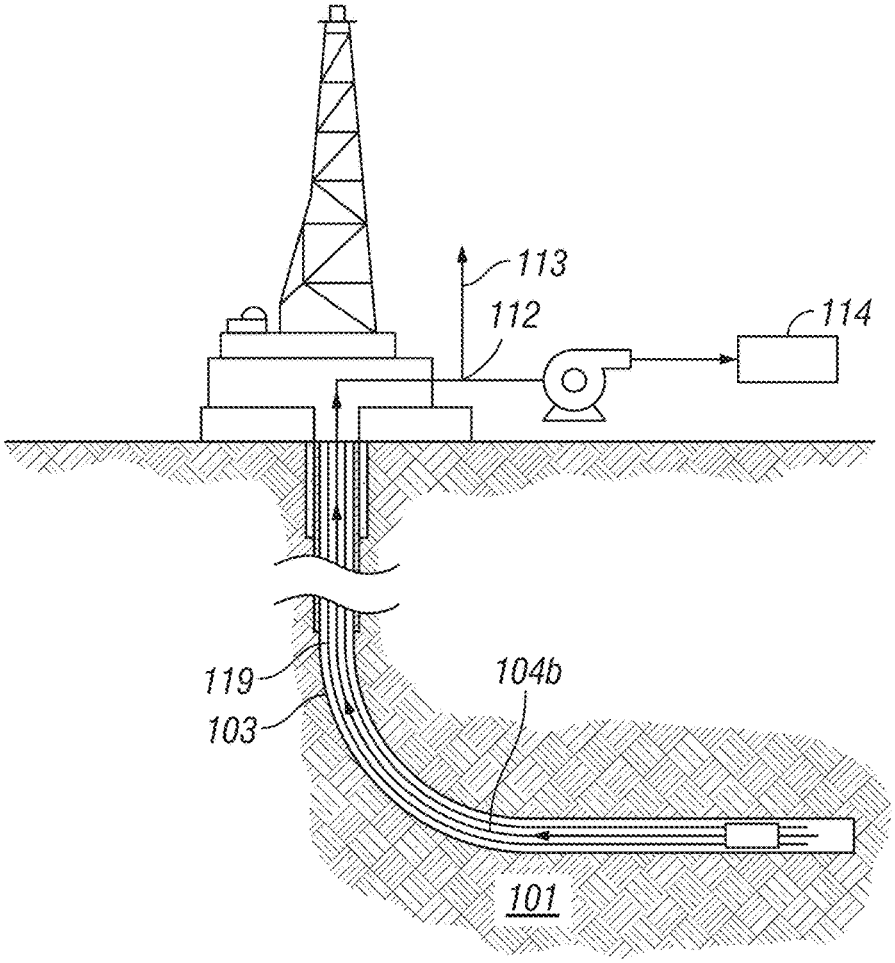
FIG. 2 is a side view of a system where a remnant fluid with a tracer additive is produced from a wellbore according to embodiments of the disclosure.
Figure 3:
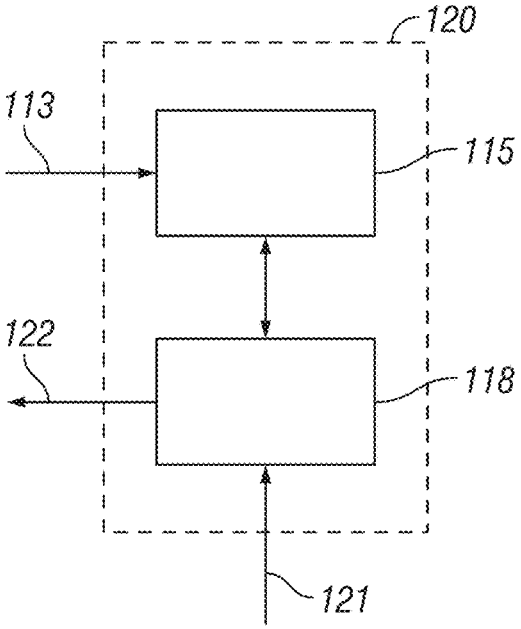
FIG. 3 is a simplified block diagram of an analytical unit used to test a fluid sample having a tracer additive according to embodiments of the disclosure.

FIGS. 2 and 3 illustrate whereby the first tracer 105*a* may be brought back to the surface 102 for testing. For example, after the predetermined time period, a remnant fluid 104*b* may be produced. The remnant fluid 104*b* may include, at least partially, (some of) the first tracer 105*a* and formation fluids F. A sample of the remnant fluid 104*b* may be produced on a desired frequency, such as daily. The sampling can occur during the desired frequency over a predetermined timeframe, which may be days or months (e.g., 6 months).

Once the remnant fluid 104*b* is produced from the wellbore 103, a sample 113 may be taken or extracted (such as from a sample point 112). The rest of the remnant fluid 104*b* may be transferred to a desired destination 114, which may be a tank, a pond, another well, or other suitable storage.

The sample 113 may now be tested via test unit 120. The test unit 120 may include analysis equipment 115, which may be in operable communication with computing system 118. The computing system 118 may be configured for use in using analytical data associated with use of the test equipment 115. The test equipment 115 may provide a fluorescence response-based process, such as EDXRF and XRD.

The computing system 118 may be useful to further analyze data and other information in order to provide an indication related to performance of the wellbore 103. This may pertain to, for example, the time the tracer additive was detected, the location where the tracer additive was use, the type and composition of the tracer additive detected, the amount or concentration of tracer additive detected, and/or other measurements provided by the equipment 115 and the system 118.

The computing system 118 may have Artificial intelligence (A.I.) based flow diagnostics. The computing system 118 may access input data 121, which may be related to other aspects of the formation 101, such as geological information, fractures, and the like. The computing system 118 may include programs, scripts, and/or other types of computer instructions that generate output data 122, which may be based on the input data 121. The output data 122 may include descriptions of fluid flow patterns in the formation 101, which may identify paths of fluid flow in the wellbore 101, wellbore breaches or cross-communication (such as to a proximate offset well), fracture locations, fluid flow rates, and/or other information.

FIG. 1C shows that a downhole tool 123*b* may be provided or otherwise disposed into the wellbore 103, which may be directed to the same or different target formation. The second downhole tool 123*b* may be disposed into the wellbore 103 in a similar manner as that of the downhole tool 123, such as via coupled with the tubestring 119. The second downhole tool 123*b* may have one or more deployment devices 124, which may be comparable or identical to those used with the downhole tool 123. Any deployment device may have the tracer additive 105*a* or another or second tracer additive disposed therein (not viewable here).

The second tracer additive may be like that of the first tracer additive 105*a*, and thus have similar composition and characteristics; however, the second tracer additive may have a second composition different from that of the first composition. The use of a different composition provides a unique identifier and fingerprint as compared to that of the composition.

The second composition may be different from the first composition, yet the second tracer may have characteristics similar to that of the first tracer 105*a*. For example, the second tracer may be solid (in powder form) having a respective bulk average particle diameter of about 0.01 μm to about 10 μm. The second tracer may have a respective average bulk specific gravity of about 0.6 to about 1.6.

As before with the first tracer 105*a*, after the predetermined time period, a remnant fluid 104*b* may be produced. The remnant fluid 104*b* may include, at least partially, (some of) the first tracer 105*a*, the second tracer, formation fluids F, and combinations thereof. Once the remnant fluid 104*b* is produced from the wellbore 103, a sample 113 may be taken or extracted from sample point 112.

The system 100 may be modified or adjusted based on the detection of tracers released from the formation 101. For example, well system tools, and/or other subsystems may be installed, adjusted, activated, terminated, or otherwise modified based on the information provided by the tracers. Additional fractures can be formed in the formation 101, and/or other modifications can be made based on information provided by the tracers. In some embodiments, modifications of the system 100 may be selected and/or parameterized to improve production from the formation 101. For example, the modifications may improve the sweep efficiency. Modifications of well system 100 may be selected and/or parameterized by the computing system based on data analysis performed by the computing system. Other or additional tracer additives and/or deployment devices may be used as desired.

Figure 5A:
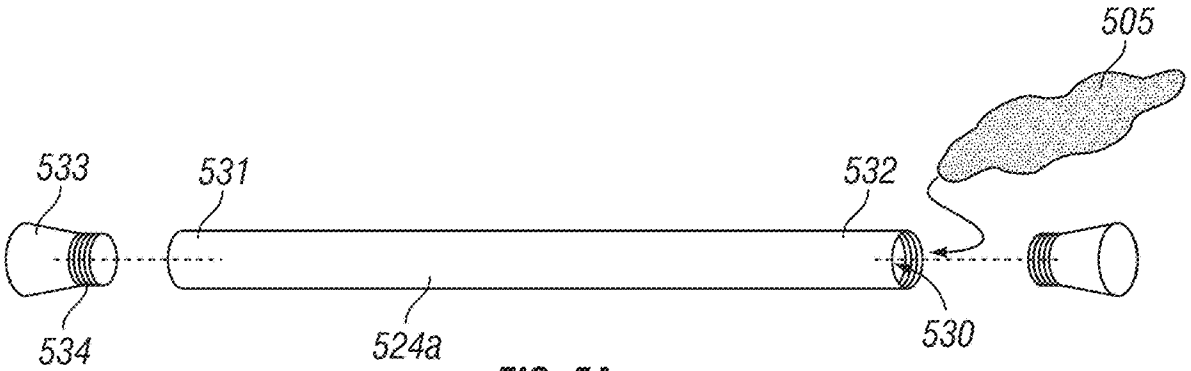
FIG. 5A shows a longitudinal side view of a dissolvable deployment device for use with a tracer additive disposed therein according to embodiments of the disclosure.
Figure 5B:
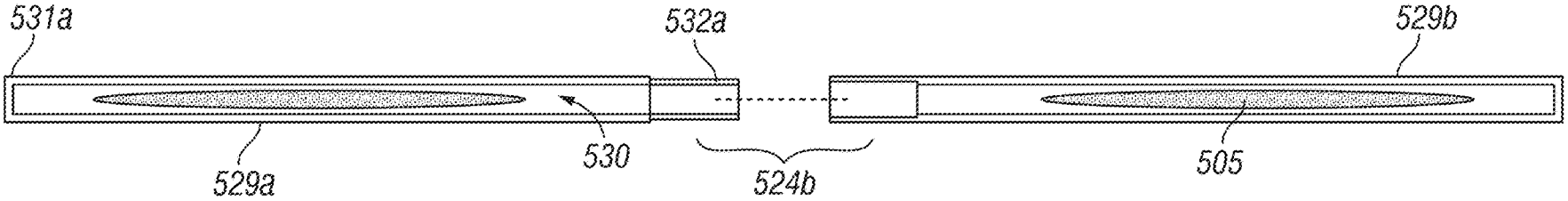
FIG. 5B shows an internal longitudinal side view of another dissolvable deployment device for use with tracer additive disposed therein according to embodiments of the disclosure.

Referring now to FIGS. 5A and 5B, a longitudinal side view of a dissolvable deployment device for use with a tracer additive disposed therein and a longitudinal side view of another dissolvable deployment device for use with tracer additive disposed therein, respectively, according to embodiments disclosed herein, are shown.

FIGS. 5A and 5B show varied embodiments of a deployment device 524*a*, 524*b*, which may be used with or as part of any kind of downhole tool, such as those described herein. Although the deployment device 524*a*, 524*b* may be elongated or rod-shaped, with a (inner) hollowed region 530, as shown here, other shapes or configurations are possible. The tracer additive 505 may be a solid particulate material like that of tracer additives described herein. The deployment device may be separable into one or more sections, etc., whereby the additive 505 may be disposed therein.

FIG. 5A shows a first embodiment where the deployment device 524*a* may have openings on either end 531, 532, whereby the tracer additive 505 may be added therein. To maintain the tracer additive 505 within the hollowed region 530, a securing or closure member 533 may be engaged to the ends 531, 532. The ends 531, 532 and the member(s) 533 may be configured with mating features, such as threads 534 (e.g., male, female).

FIG. 5B shows another embodiment where the employment device 524*b* may be configured with one or more sections 529*a*, 529*b*. Either end 531*a*, 532*a* of the sections 529*a*, 529*b* may be open, closed, or combinations thereof. As shown here, the first section 529*a* may have an end 532*a* configured for mating with a corresponding end of the second section 529*b*, such as male and female threads. However, forms of a deployment device are possible.

The deployment devices 524*a*, 524*b* may be made of a reactive material configured to dissolve, at least partially, based on wellbore fluid composition. Reactive materials may include materials suitable for and are known to dissolve, degrade, etc. in downhole environments [including extreme pressure, temperature, fluid properties, etc.] after a brief or limited period of time (predetermined or otherwise) as may be desired). In an embodiment, a component made of a reactive material may begin to react within about 24 to about 60 hours after exposure to a reaction-inducing stimulant. The time of reaction is not meant to be limited, and could be shorter (such as 1 minute to 24 hours), or could be longer (such as in excess of 2 days).

In embodiments, any deployment device of the present disclosure may be made of a metallic material, such as an aluminum-based or magnesium-based material. The metallic material may be reactive, such as dissolvable, which is to say under certain conditions the respective component(s) may begin to dissolve, and thus alleviating the need for drill thru. These conditions may be anticipated and thus predetermined. In embodiments, the components may be made of dissolvable aluminum-, magnesium-, or aluminum-magnesium-based (or alloy, complex, etc.) material.

Figure 5C:
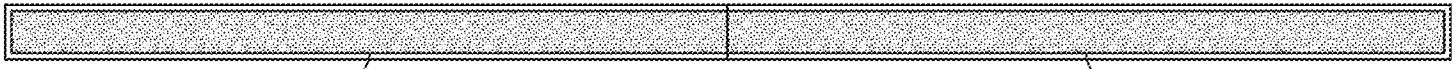
FIG. 5C shows an internal longitudinal side view of a dissolvable deployment device with an inner volume completely filled with a tracer additive disposed therein according to embodiments of the disclosure.

Referring briefly to FIG. 5C, an internal longitudinal side view of a dissolvable deployment device with an inner volume completely filled with a tracer additive, according to embodiments herein, is shown. The deployment device 524 may be comparable to others described herein. As depicted, the deployment device 525 (which may have its sections coupled together) may have the inner volume or hollowed region 530 with the tracer additive 505 disposed therein. The entire volume of the hollowed region 530 may be filled with the tracer additive 505, such that there is no discernable voids or spaces. For example, it may be desirous to pack or fill the entire hollow region 530 of (or each respective section) with the tracer 505. This may maximize the used, and and increase the duration of tracer recovery and detection.

Figure 6A:
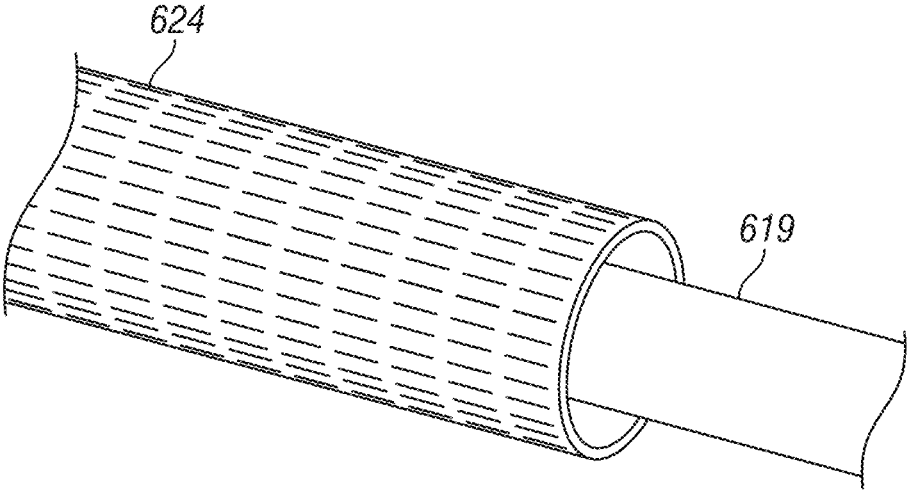
FIG. 6A shows an isometric partial view of a dissolvable component of a downhole tool according to embodiments of the disclosure.
Figure 6B:
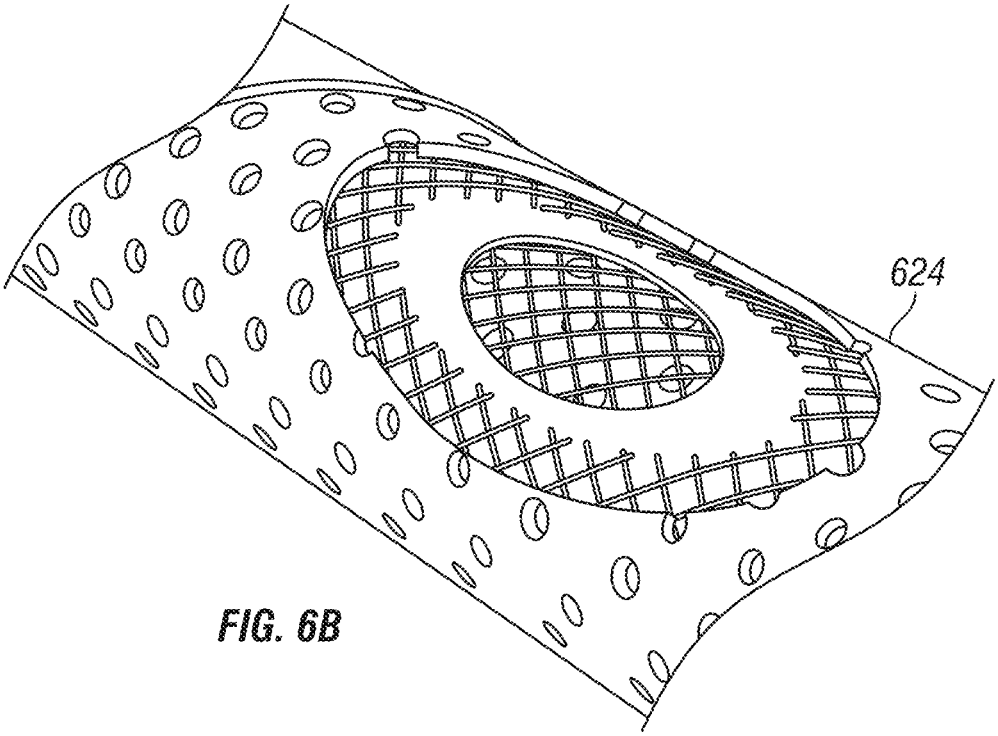
FIG. 6B shows an isometric partial view of another type of dissolvable component of a downhole tool according to embodiments of the disclosure.
Figure 6C:
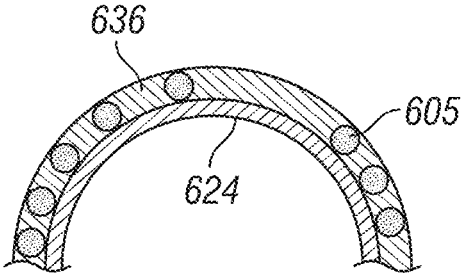
FIG. 6C shows a simplified cross-sectional view of a downhole tool component having a dissolvable surface coating with an embedded tracer additive according to embodiments of the disclosure.

Referring now to FIGS. 6A, 6B, and 6C, an isometric partial view of a dissolvable component of a downhole tool, an isometric partial view of another type of dissolvable component of a downhole tool, and a simplified cross-sectional view of a downhole tool component having a dissolvable surface coating with an embedded tracer additive, respectively, according to embodiments disclosed herein, are shown.

FIGS. 6A-6C show varied embodiments of a deployment device 624, which may be used with or as part of any kind of downhole tool, such as those described herein. As shown here, the deployment device 624 may be a component, such as a screen, which may be configured with a surface coating 636. The surface coating 636 may have adhesion properties, for which the coating may reside on any surface of the deployment device 624. In such an embodiment, a tracer additive (such as described herein) may be mixed or embedded with the coating 636. The coating 636 may be made of a reactive material (such as those described herein) configured to dissolve, at least partially, based on wellbore fluid composition. The deployment device 624 may coupled with a tubestring (workstring, etc.) (or component thereof) 619, which may be useful to run or position the device 624 at a desired location in a wellbore (e.g., 403)

The tracer additive 605 (shown here to be illustrative; not to scale) may be prevented from mixing with downhole fluids until a sufficient amount of coating has dissolved away. Control of the release of the tracer 605 additive may occur by varying the thickness or the amount of the surface coating 636. The deployment device 624 may have a plurality of differing filtration layers (see FIG. 6B; slotted screens, holes, mesh, etc.), as may be desired.

Example

Embodiments herein provide for a method of using tracer technology, such as solid ultrahigh resolution nanoparticles. Methods of the disclosure may provide for a tracer portfolio that integrates advanced computational methods using Artificial Intelligence (A.I.). Such use may provide accurate, actionable, near real-time performance-flow-profile data. This may allow oil and gas operators to: optimize completion strategies; achieve the best production per foot; reduce completion and fracturing cost; and/or reduce environmental footprint.

Tracer technology described herein may be based on proprietary inert submicron particles and other environmentally friendly and cost-effective additives that are used to manufacture the right composition of each tracer. This tracer technology may utilize special inert particles fingerprinting with certain atoms as special indicators that enhance the properties of each tracer. These may then be detected at the sub-atomic structure level using robust capabilities of EDXRF-type spectroscopy measurements, and therefore ensuring superior accuracy for each tracer's detection and characterization from different subsurface environments.

Deployed tracers are then recovered with production flowback or produced fluids from treatment or/and adjacent wells. During the back flowing of the well, reservoir oil/gas samples are taken on a regular basis, such as for the first 10 to 40 days. The number of days may as desired, such as up to 180 days. A small amount of the sample is analyzed using appropriate methods to detect the presence and concentration of tracer compound. Samples from traced and/or offset wells may be collected on a predetermined basis (such as daily) from production flowback at the wellhead or other suitable sample point. The sample may then be tested via a fluorescence response-based process, such as EDXRF and XRD. Such analytical techniques may be used to determine the elemental composition and crystallinity of the samples.

EDXRF is designed to analyze groups of elements simultaneously to determine those elements presence in the sample and their relative concentrations—in other words, the elemental composition of the sample. Each of the elements present in a sample produces a unique set of characteristic X-rays that is a "fingerprint" for that specific element. X-rays have a very short wavelength, which corresponds to very high energy.

Due to sub-atomic accuracy of both detection methods, it is possible to precisely determine the elemental composition, crystallographic structure, and the various combinations of hyperfine interactions in the samples, which enables very accurate identification of the tracer additives on the sub-atomic or quantum level.

Laboratory analysis that may include or incorporate advanced computational methods and proprietary diagnostics capabilities for each stage or target formation provides accurate, calibrated, actionable and cost-effective production diagnostics results. This enables operators to reduce operational cost and increase the production in oil and gas wells.

Embodiments herein may produce and achieve an extensive and long-term dataset from tracer additives during production flow profile analysis at each target formation. This information may be used together with advanced computational methods using Artificial Intelligence (A.I.) coupled with artificial neural network may provide precise completion optimization workflows for oil and gas wells.

Embodiments herein pertain to a method(s) of using a tracer additive in a wellbore. The method may include one or more steps, which may vary in sequence and scope. The method may include obtaining a deployment device, and disposing a tracer additive therein. The deployment device may then be disposed or otherwise transferred into the wellbore, such as via a tubestring.

Upon contacting or proximately locating the deployment device with the target formation for an amount of time (which may be predetermined or as otherwise desired), the deployment device may begin to, at least partially, dissolve. As such, the deployment device may be made a reactive material suitable for reacting with wellbore fluids.

Upon at least partial dissolving, the first tracer additive may disperse into the wellbore (or associated target formation and/or fluids). The method may include at some point later returning (producing, etc.) a remnant fluid to a surface. One of skill would appreciate the surface refers to above-ground production equipment, facilities, and so forth, being common in production operations.

The method may include taking a sample of the remnant fluid, and then testing the sample in order to analyze the remnant fluid in order to provide a set of fluid data. The method may include integrating (or otherwise analyzing, comparing, etc.) the set of fluid data with other wellbore data in order to determine a parameter associated with performance of the wellbore.

The method may utilize the tracer additive having a first tracer composition. The tracer additive may be in powder (i.e., solid) form having a bulk average particle diameter of at least 0.01 μm to no more than 10 μm. The tracer additive may have a bulk average specific gravity. For example, the average bulk specific gravity may be in a range of at least 0.6 to no more than 1.6.

The method may include additional steps, such as disposing a second deployment device that may have a second tracer additive disposed therein into the wellbore. The disposing step may be done in such a manner that the second deployment device may come into contact with one or more of the target formation, another target formation proximate to the wellbore, or combinations thereof.

The second tracer additive may have a different composition from the first chemical tracer, but otherwise may also be in powder form, may have an average particle diameter of at least 0.1 μm to no more than 10 μm, and may have average bulk specific gravity of at least 0.6 to no more than 1.6.

The testing the sample step may include using a fluorescence response-based analysis. In aspects, the fluorescence response-based analysis may include use of EDXRF. In aspects, the fluorescence response-based analysis many include use of XDR.

Embodiments herein may provide for a method of performing downhole deployment of a tracer additive in a wellbore, which may be during a construction phase of the wellbore. The method may include using a tubestring with a downhole tool to run or position the downhole tool to a section of the wellbore, such as a target formation.

The method may include allotting for an amount of time to pass whereby a dissolvable material associated with the downhole tool sufficiently dissolves so that the tracer additive comes into contact with a target formation fluid, whereas otherwise the solid particle tracer additive is prevented from contacting the target formation fluid.

In aspects, the wellbore construction phase may be defined by a first period of time that occurs starting at a point in time when drilling the wellbore starts and ending at a latter point in time when a first amount of fluid is produced from the section of the wellbore.

The method may include performing an operation associated with the wellbore that includes one or any of: use of multi-lateral flow mapping, use of multi-zone flow mapping, enhanced oil recovery (EOR), plug-and-abandonment, integrity testing of casing, fluid injection, use of an electric submersible pump (ESP), carbon capture and storage (CCS), carbon capture, usage, and storage (CCUS), and combinations thereof.

The target formation may have or include water or other form of aqueous component. In aspects, the dissolvable material may undergo an at least partial chemical reaction in the presence of the aqueous component.

Advantages

Embodiments herein may provide for a new and improved method and system related to the use of tracers in various settings associated with an earthen formation, such as an oil and gas well.

The tracer may be cost-effective and insoluble, inert, stable at (excessively) high temperatures, compatible with formation fluids, non-intrusive to completion design, easy to use, and quickly tested. Other advantages may include use of tracers that are of a cost-effective material, inert and lightweight, easily deployed, non-hazardous and non-radioactive, a single tracer for water and oil phases, and precise sub-atomic accuracy.

The tracer may be deployed via a transportation or deployment device, which may be made of a reactive material that dissolves over a period of time. Thus, the tracer is not directly surface deployed by mixing into a pump-down stream; instead, the tracer deploys once the deployment device sufficiently dissolves in order to release the tracer.

While embodiments of the disclosure have been shown and described, modifications thereof may be made by one skilled in the art without departing from the spirit and teachings of the disclosure. The embodiments described herein are exemplary only and are not intended to be limiting. Many variations and modifications of the embodiments disclosed herein are possible and are within the scope of the disclosure. Where numerical ranges or limitations are expressly stated, such express ranges or limitations should be understood to include iterative ranges or limitations of like magnitude falling within the expressly stated ranges or limitations. The use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, and the like.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the preferred embodiments of the present disclosure. The inclusion or discussion of a reference is not an admission that it is prior art to the present disclosure, especially any reference that may have a publication date after the priority date of this application. The disclosures of all patents, patent applications, and publications cited herein are hereby incorporated by reference, to the extent they provide background knowledge; or exemplary, procedural or other details supplementary to those set forth herein.

What is claimed is:

1. A method of performing downhole deployment of a solid particle tracer additive in a wellbore, the method comprising:

during a construction phase of the wellbore, operating a tubestring to position a downhole tool in a section of the wellbore, the downhole tool comprising an at least one elongated rod made of a dissolvable material and having a hollowed region, and the solid particle tracer additive is disposed in the hollowed region;

then, allotting for an amount of time to pass whereby the dissolvable material associated with the elongated rod sufficiently dissolves so that the solid particle tracer additive comes into contact with a target formation fluid, whereas otherwise the solid particle tracer additive is prevented from contacting the target formation fluid;

taking a sample of a wellbore fluid in order to test the sample at a surface facility; and at the surface facility, testing the sample by using non-destructive energy dispersive x-ray fluorescence (EDXRF) via energy excitation at a sub-atomic level in order to determine elemental composition, wherein the construction phase is defined by a first period of time that occurs starting at a point in time when drilling the wellbore starts and ending at a latter point in time when a first amount of fluid is produced from the section of the wellbore, wherein the solid particle tracer additive is insoluble or inert in each of water, hydrocarbonaceous fluids, the target formation fluid, and combinations thereof.

2. The method of claim 1, the method further comprising performing an operation associated with the wellbore that comprises one of: flow mapping, enhanced oil recovery (EOR), plug-and-abandonment, integrity testing of casing, fluid injection, pressurization via use of a pump, carbon capture and storage (CCS), carbon capture, usage, and storage (CCUS), and combinations thereof.

3. The method of claim 2, wherein the elongated rod is defined by a first section having a first end configured to mate with a second end of a second section.

4. The method of claim 3, wherein the wellbore is associated with a formation temperature of at least 200° F. to no more than 1,000° F.

5. The method of claim 4, wherein the solid particle tracer additive further comprises a first tracer composition, wherein the solid particle tracer additive has an average bulk particle diameter of at least 0.01 μm to no more than 10 μm, and wherein the solid particle tracer additive has an average bulk specific gravity of at least 0.6 to no more than 1.6, wherein the elongated rod has a first open end and a second open end, and wherein the inner hollowed region is enclosed by inserting respective closure members in the first open end and the second open end.

6. The method of claim 3, wherein the wellbore is associated with a formation temperature of at least 450° F. to no more than 2000° F., and wherein a portion of a target formation adjacent the wellbore has an average permeability of 0.1 nanodarcy to 1000 nanodarcy.

7. The method of claim 6, wherein the target formation fluid comprises an aqueous component, and wherein the dissolvable material undergoes an at least partial chemical reaction in the presence of the aqueous component.

8. The method of claim 3, wherein the elongated rod comprises a surface coating material, and wherein the dissolvable material has a rate of dissolution based on a property of an at least one of: the elongated rod, the surface coating material, a set of conditions of the wellbore, and combinations thereof.

9. The method of claim 3, wherein the downhole tool comprises a plurality of elongated rods, each made of a respective dissolvable material.

10. The method of claim 3, wherein the solid particle tracer additive is also used in a surface coating on part of the downhole tool or another component thereof.

11. The method of claim 3, wherein testing the sample results in a set of flow profiling data associated with the wellbore fluid based on solid particle tracer additive production.

12. The method of claim 11, wherein the downhole tool comprises a screen, wherein the solid particle tracer additive further comprises a first tracer composition, wherein the solid particle tracer additive has an average bulk particle diameter of at least 0.01 μm to no more than 10 μm, and wherein the solid particle tracer additive has an average bulk specific gravity of at least 0.6 to no more than 1.6.

13. A method of performing downhole deployment of a tracer additive in a wellbore, the method comprising:

during a completion phase of the wellbore, operating a tubestring to run a downhole tool to a section of the wellbore, the downhole tool comprising an at least one elongated rod made of a dissolvable material and having a hollowed region, and the tracer additive is disposed in the hollowed region;

then, allotting for an amount of time to pass whereby the dissolvable material sufficiently dissolves so that the tracer additive comes into contact with a target formation fluid, whereas otherwise the tracer additive is prevented from contacting the target formation fluid;

performing an operation associated with the wellbore that comprises one of: flow mapping, enhanced oil recovery (EOR), plug-and-abandonment, integrity testing of casing, fluid injection, pressurization via pumping, carbon capture and storage (CCS), carbon capture, usage, and storage (CCUS), and combinations thereof;

taking a sample of a wellbore fluid having at least a portion of the tracer additive therein; and testing the sample with non-destructive energy dispersive x-ray fluorescence (EDXRF) via energy excitation at a sub-atomic level in order to determine elemental composition to provide a set of fluid data associated with the wellbore fluid, wherein the elongated rod has a first open end and a second open end, and wherein the inner hollowed region is enclosed by inserting respective closure members in the first open end and the second open end, and wherein the completion phase is defined by a first period of time that occurs starting at a point in time when a drill string is removed from the wellbore and ending at a latter point in time when a first amount of fluid is produced from the section of the wellbore.

14. The method of claim 13, wherein the wellbore is associated with a formation temperature of at least 450° F. to no more than 2000° F., and wherein the target formation has an average permeability of 0.1 nanodarcy to 1000 nanodarcy.

15. The method of claim 14, the method further comprising integrating the set of fluid data with other wellbore data in order to determine flow mapping performance of the wellbore.

16. The method of claim 15, wherein the tracer additive is insoluble in at least one of water, hydrocarbonaceous fluids, the target formation fluid, and combinations thereof, wherein the tracer additive is in solid particle form, with an average bulk particle diameter of at least 0.01 μm to no more than 10 μm.

17. The method of claim 14, wherein the dissolvable material has a rate of dissolution based on a property of an at least one of: the dissolvable material, a set of conditions of the wellbore, and combinations thereof.

18. A method of performing downhole deployment of a solid particle tracer additive in a wellbore, the method comprising:

during a construction phase of the wellbore, operating a tubestring to position a downhole tool in a section of the wellbore, the downhole tool comprising: a screen; and an at least one elongated rod made of a dissolvable material and having a hollowed region, and the solid particle tracer additive is disposed in the hollowed region;

then, allotting for an amount of time to pass whereby the dissolvable material associated with the elongated rod sufficiently dissolves so that the solid particle tracer additive comes into contact with a target formation fluid, whereas otherwise the solid particle tracer additive is prevented from contacting the target formation fluid;

performing an operation associated with the wellbore that comprises one of: flow mapping, enhanced oil recovery (EOR), plug-and-abandonment, integrity testing of casing, fluid injection, pressurization via pumping, carbon capture and storage (CCS), carbon capture, usage, and storage (CCUS), and combinations thereof;

taking a sample of a wellbore fluid in order to test the sample at a surface facility; and at the surface facility, testing the sample by using non-destructive energy dispersive x-ray fluorescence (EDXRF) via energy excitation at a sub-atomic level in order to determine elemental composition, wherein the construction phase is defined by a first period of time that occurs starting at a point in time when drilling the wellbore starts and ending at a latter point in time when a first amount of fluid is produced from the section of the wellbore, wherein the solid particle tracer additive is insoluble or inert in each of water, hydrocarbonaceous fluids, the target formation fluid, and combinations thereof, wherein the dissolvable material has a rate of dissolution based on a property of an at least one of:

the dissolvable material, a set of conditions of the wellbore, and combinations thereof, wherein the tracer additive is in solid particle form, with an average bulk particle diameter of at least 0.01 μm to no more than 10 μm, wherein the wellbore is associated with a formation temperature of at least 450° F. to no more than 2000° F., wherein the solid particle tracer additive has an average bulk specific gravity of at least 0.6 to no more than 1.6, and wherein the target formation has an average permeability of 0.1 nanodarcy to 1000 nanodarcy.

* * * * *